US005150807A

United States Patent [19]

Seyfried et al.

[11] Patent Number: 5,150,807

[45] Date of Patent: Sep. 29, 1992

[54] APPARATUS FOR STORING MARKING PARTICLES

[75] Inventors: Joseph A. Seyfried, Webster; Chetan G. Patel, Penfield, both of N.Y.

[73] Assignee: Xerox Corporation, Stamford, Conn.

[21] Appl. No.: 802,977

[22] Filed: Dec. 6, 1991

Related U.S. Application Data

[63] Continuation-in-part of Ser. No. 754,858, Sep. 4, 1991.

[51] Int. Cl.[5] ..... B65D 41/00

[52] U.S. Cl. ..... 220/359; 355/215; 355/260; 222/DIG. 1; 141/364; 220/346

[58] Field of Search ..... 355/215, 260; 222/DIG. 1; 206/216, 576, 578; 220/345, 346, 359; 141/363, 364, 365, 366

[56] References Cited

U.S. PATENT DOCUMENTS

| | | | |
|---|---|---|---|
| 3,999,654 | 12/1976 | Pollack | 206/216 |
| 4,062,385 | 12/1977 | Katusha et al. | 141/89 |
| 4,065,335 | 12/1977 | Pollack | 156/69 |
| 4,089,601 | 5/1978 | Navone | 355/245 |
| 4,441,636 | 4/1984 | Yamashita et al. | 222/541 |
| 4,478,512 | 10/1984 | Zoltner | 355/260 |
| 4,491,161 | 1/1985 | Tamura et al. | 141/364 |
| 4,614,286 | 9/1986 | Yamaguchi et al. | 222/505 |
| 4,799,608 | 1/1989 | Oka | 222/505 |
| 4,862,210 | 8/1989 | Woolley | 355/245 |
| 4,937,628 | 6/1990 | Cipolla et al. | 355/260 |

*Primary Examiner*—A. T. Grimley
*Assistant Examiner*—P. J. Stanzione
*Attorney, Agent, or Firm*—Paul J. Maginot

[57] ABSTRACT

An apparatus for storing marking particles is described which includes a container defining a chamber for storing the marking particles therein and having an opening defined therein for the discharge of the marking particles therefrom. The apparatus further includes a seal member secured to the container, the seal member having an opening defined therein which is at least partially coextensive with the opening of the container for the passage of marking particles therethrough. Moreover, the apparatus includes a cover positionable over the opening defined in the seal member, the cover being removably secured to the seal member with an adhesive material.

7 Claims, 15 Drawing Sheets

FIG. 3
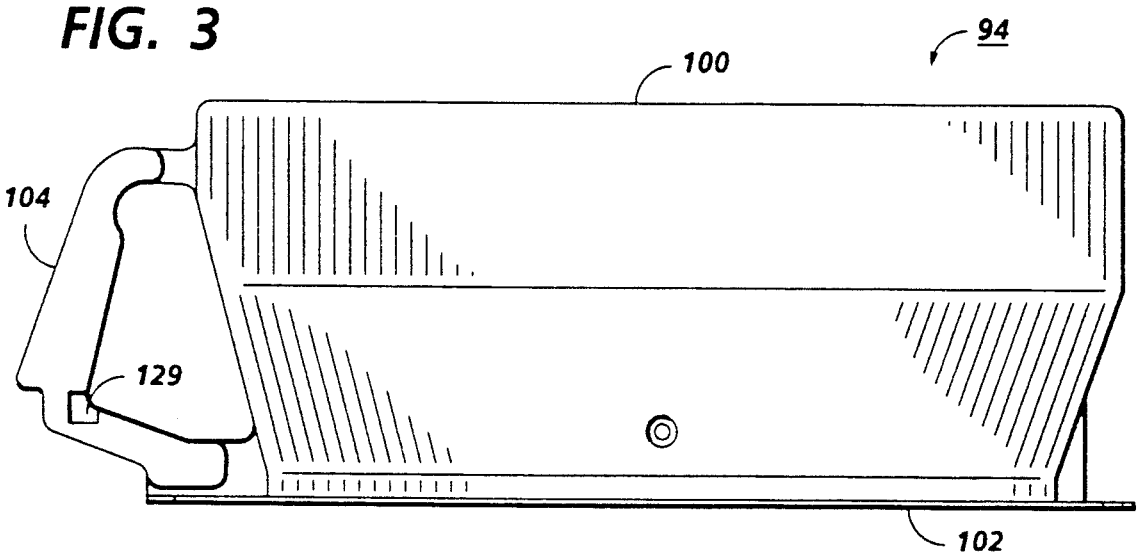
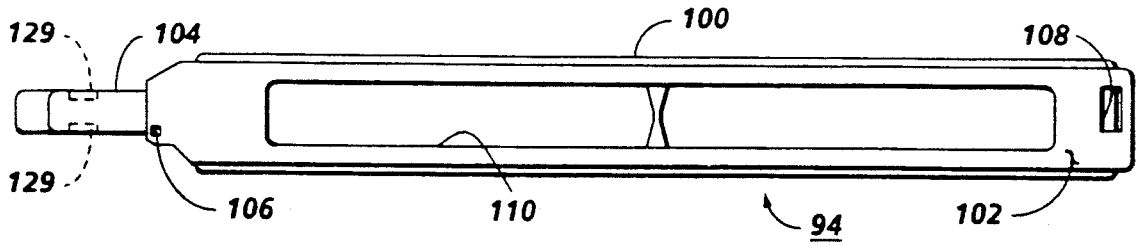
FIG. 4

FIG. 19
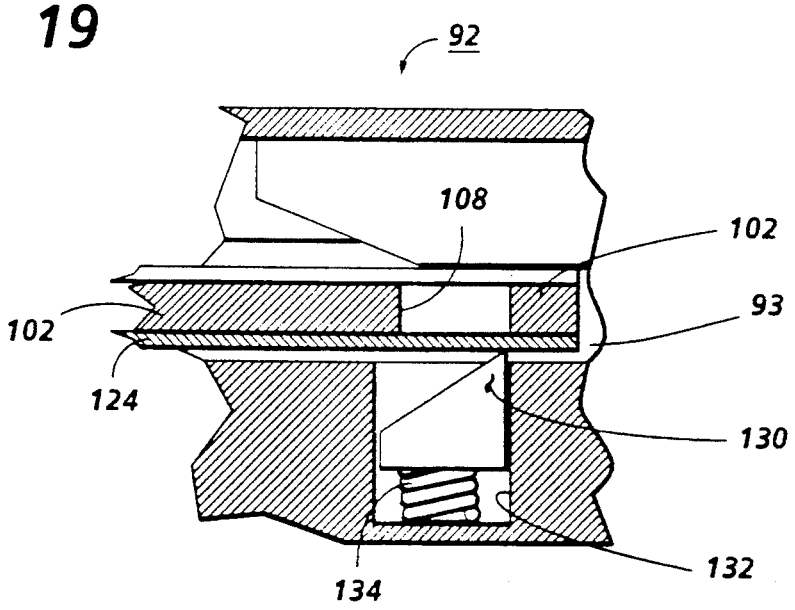
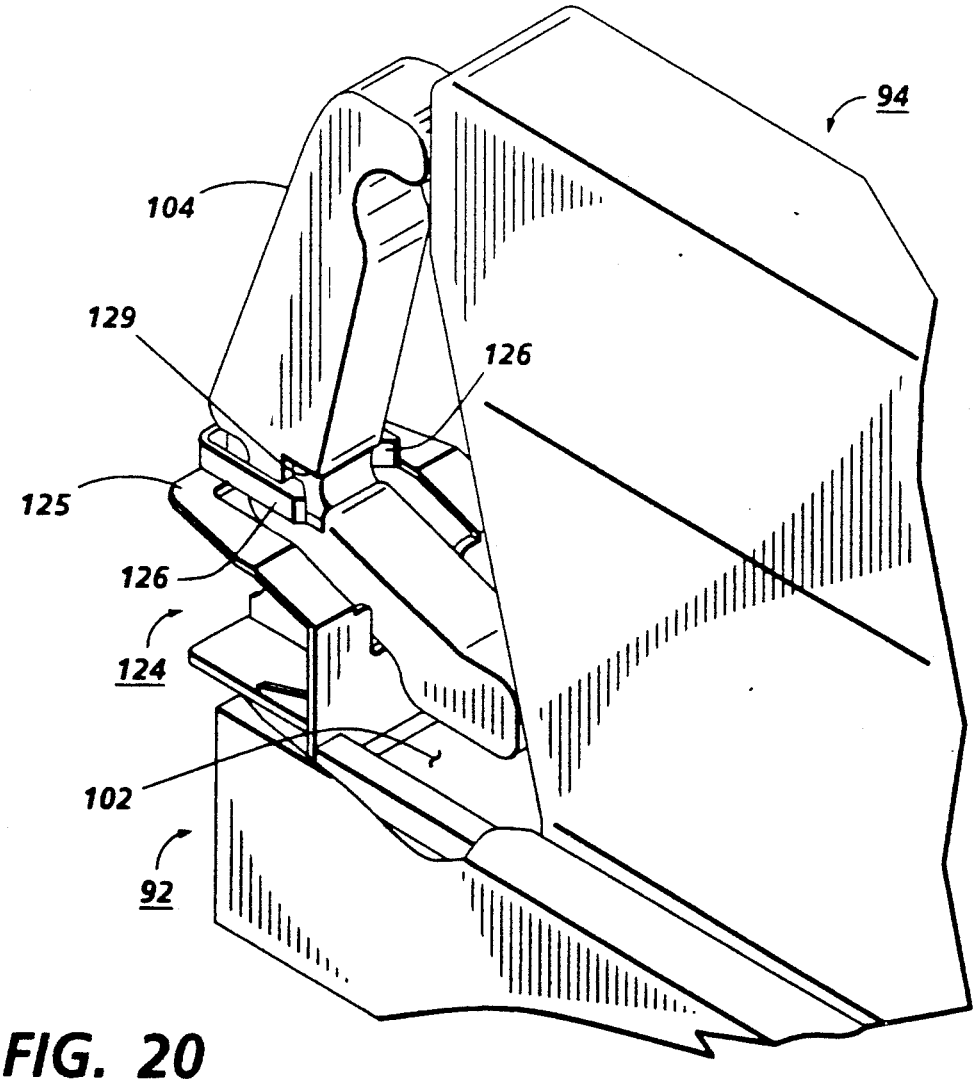
FIG. 20

FIG. 21
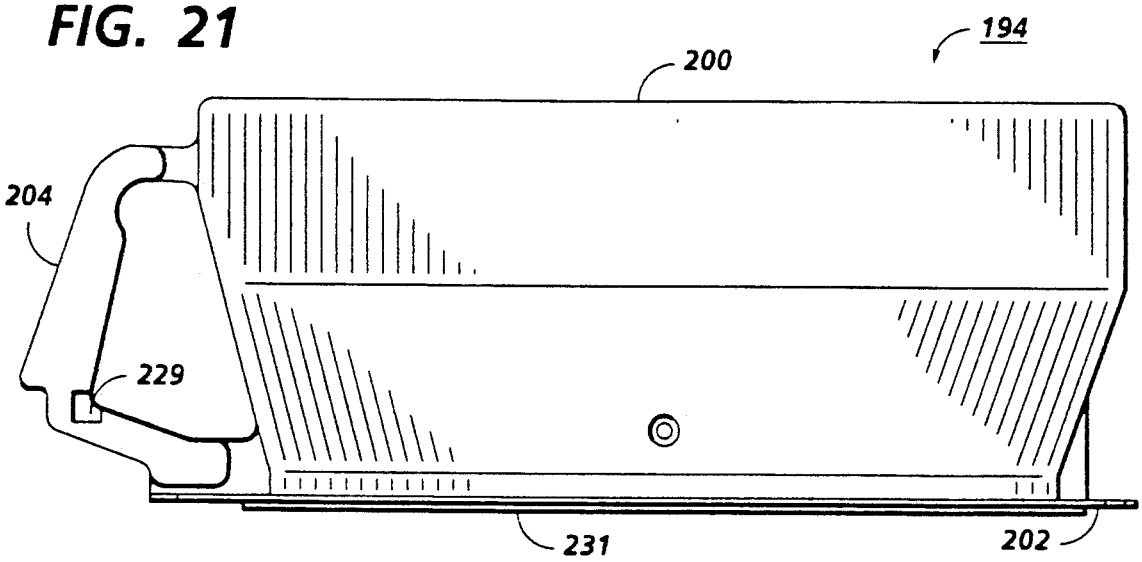
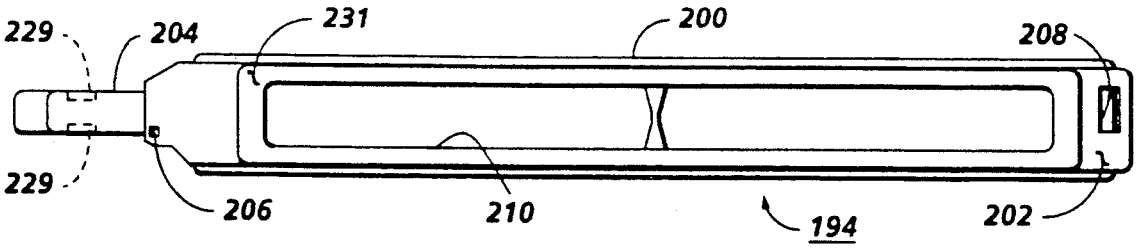
FIG. 22

APPARATUS FOR STORING MARKING PARTICLES

This application is a continuation-in-part of the copending application entitled "Improved Apparatus for Storing Marking Particles for Use in an Electrophotographic Printing Machine." Ser. No. 07/754,858, filed Sep. 4, 1991, and assigned to the same assignee as the present invention.

This invention relates generally to an apparatus for storing marking particles therein which is useful in an electrophotographic printing machine.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed in an imaging zone to a light source such as a raster output scanner. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. Generally, the developer material comprises toner particles adhering triboelectrically to carrier granules. The toner particles are attracted to the latent image from the carrier granules to form a toner image on the photoconductive member which is subsequently transferred to a copy sheet. The copy sheet is then heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy.

As the toner particles are depleted from the developer material, in each of the above processes of printing, it is necessary to dispense additional toner particles into the developer mixture. In this way, the concentration of toner particles within the developer mixture is maintained substantially constant. To achieve the above, electrophotographic printing machines frequently have dispensers which discharge toner particles into the development system. After a period of time, it is necessary to replenish the toner particles within the dispenser.

When adding additional toner particles to the dispenser in the printing machine, any spillage thereof results in contamination of the proximate areas having the spilled toner particles thereon. The toner particles, being very finely ground, also become airborne and consequently carry this contamination to other areas not proximate to the development system. Furthermore, the spilled toner particles also have a tendency to cling to the operator's hands or to the surrounding environment. It is thus clear that the addition of toner particles into the printing machine is a dirty and messy task during which frequent and inadvertent spills on the operator's hands and clothing occur. It is, therefore, highly desirable to provide a system which supplies toner particles to the development system in a manner such that the contamination of both the operator and the printing machine is minimized.

Containers that store toner particles which are used in printing machines usually have an opening defined therein for the discharge of the toner particles therefrom. Moreover, these containers sometimes have a flanged area, or the like, near the opening of the container that cooperates with another member such as a cover which is removably secured to such flanged area in order to achieve a substantially leak-tight coupling between the two members. Sometimes it is difficult to manufacture flanges on these containers which are sufficiently flat. The above flange condition results in an undesirable leaking of toner particles from the mating area between the container and the cooperating member. One solution is to sand the flange to achieve the required flatness, however, this solution increases the cost of the container and may even introduce a contaminant into the otherwise non-contaminated toner particles. It would be desirable to provide a low cost container that was capable of mating with a cooperating member to achieve a substantially leak-tight coupling between the container and the cooperating member.

The following disclosures may be relevant to various aspects of the present invention:

U.S. Pat. No. 3,999,654
Patentee: Pollack
Issued: Dec. 28, 1976

U.S. Pat. No. 4,062,385
Patentee: Katusha et al.
Issued: Dec. 13, 1977

U.S. Pat. No. 4,065,335
Patentee: Pollack
Issued: Dec. 27, 1977

U.S. Pat. No. 4,089,601
Patentee: Navone
Issued: May 16, 1978

U.S. Pat. No. 4,441,636
Patentee: Yamashita et al.
Issued: Apr. 10, 1984

U.S. Pat. No. 4,478,512
Patentee: Zoltner
Issued: Oct. 23, 1984

U.S. Pat. No. 4,491,161
Patentee: Tamura et al.
Issued: Jan. 1, 1985

U.S. Pat. No. 4,614,286
Patentee: Yamaguchi et al.
Issued: Sep. 30, 1986

U.S. Pat. No. 4,799,608

Patentee: Oka
Issued: Jan. 24, 1989

U.S. Pat. No. 4,862,210
Patentee: Woolley
Issued: Aug. 29, 1989

U.S. Pat. No. 4,937,628
Patentee: Cipolla et al.
Issued: Jun. 26, 1990

The relevant portions of the foregoing disclosures may be briefly summarized as follows:

U.S. Pat. No. 3,999,654 describes a toner cartridge for a xerographic copier. The cartridge includes a flexible closure tongue which may be peeled from the cartridge when it is in the inverted position within the copier.

U.S. Pat. No. 4,062,385 discloses a toner container having a removable tear strip which seals an opening in the container. A slidable cover automatically removes the tear strip from the container permitting the discharge of toner particles into the toner dispenser of an electrophotographic printing machine.

U.S. Pat. No. 4,065,335 describes a process for manufacturing a xerographic toner cartridge containing toner powder situated in a container having an open end surrounded by a peripheral lip. An elongated tongue of a material is placed on top of the opening, with thermoplastic adhesive layer being disposed between the container lip and the tongue.

U.S. Pat. No. 4,089,601 describes a cartridge for supplying the developing powder in an electrophotographic copying machine. The cartridge includes an outer casing with a first opening, and a container mounted within the casing and provided with a second opening. The container is movable between a position of containment of the toner, in which it is maintained during shipment, and a position of discharge, in which it is turned upon positioning of the cartridge in the copying machine to allow for discharge of the toner into the copying machine.

U.S. Pat. No. 4,441,636 discloses a toner cartridge which includes a hollow body of cylindrical form. The cartridge is made of a nonmagnetic material and includes a feeding slot extending lengthwise thereof.

U.S. Pat. No. 4,478,512 describes a toner cartridge for storing marking particles used in an electrophotographic printing machine. The cartridge has an opening in the surface thereof for discharging the marking particles therefrom. A flexible sealing strip is secured removably to the cartridge and seals the opening in the surface to prevent the discharge of the marking particles. The sealing strip is folded back over itself in juxtaposition. A flexible backing strip has a portion of the sealing strip folded back secured thereto. As the sealing strip is removed from the cartridge, successive portions thereof are secured to the backing strip. The foregoing occurs automatically when the cartridge is inserted in a dispensing unit of the printing machine and rotated.

U.S. Pat. No. 4,491,161 discloses a toner dispensing apparatus which includes a toner receiving portion and a toner container mountable thereon. The toner receiving portion has an openable cover for opening and closing an opening portion of the toner receiving portion. The toner container unit has a container, a seal member for sealing an opening portion of the container, and a slide member connected with a portion of the seal member and slidable with respect to the opening portion. The seal member is torn off from the opening portion when the slide member is moved in conjunction with the opening motion of the openable cover.

U.S. Pat. No. 4,614,286 describes a toner container unit wherein an opening part of the toner container unit is sealed by a film-like sheet surrounding a sliding cover. When the sliding cover slides forwardly, the film-like sheet is torn off from the opening part of the toner container unit. When the sliding cover slides backwards the film sheet reseals the opening part.

U.S. Pat. No. 4,799,608 discloses a toner cartridge mounted in a developing device for supplying toner to a printing machine. One half of a doubled seal member is stuck to an open portion of the container, and the other half is fixed to a take-up roller which is journaled to the container. A cover is slidably mounted to the container to open and close the open portion of the latter. A rack which is provided on the inner surface of the cover is held in mesh with a gear which is integral with the take-up roller.

U.S. Pat. No. 4,862,210 describes a replaceable seal assembly for use in a Canon brand developer station. The seal assembly includes, in general, a seal unit and a bracket unit. The seal unit includes a generally rigid seal member having a generally flexible seal member disposed on one end thereof. The bracket unit cooperates with the other end of the generally rigid seal member whereby the seal member may be operatively engaged and disengaged in the recess that was formerly occupied by the original toner seal in the Canon brand cartridge.

U.S. Pat. No. 4,937,628 discloses an apparatus for storing and dispensing particulate material. The apparatus includes a container having an opening defined in the surface for dispensing the particulate material. The apparatus further includes a movable door which is larger than the opening defined in the container. A compressible micro-cellular open celled foam seal is positioned between the door and the container.

In accordance with one aspect of the present invention, there is provided an apparatus for storing marking particles which includes a container defining a chamber for storing the marking particles therein and having an opening defined therein for the discharge of the marking particles therefrom. The apparatus further includes a seal member secured to the container, the seal member having an opening defined therein which is at least partially coextensive with the opening of the container for the passage of marking particles therethrough. Moreover, the apparatus includes a cover positionable over the opening defined in the seal member, the cover being removably secured to the seal member with an adhesive material.

Other features of the present invention will become apparent as the following description proceeds and upon reference to the drawings, in which:

FIG. 3 is a side elevational view of a toner container used in the development unit of FIG. 2;

FIG. 4 is a bottom elevational view of the toner container of FIG. 3;

FIG. 19 is a fragmentary sectional elevational view showing the removal cover engaged to the toner container and further showing the toner container unlocked from the dispensing mechanism;

FIG. 20 is a fragmentary perspective view showing the removal cover engaged and locked to the toner container and further showing the toner container coupled to the dispensing mechanism;

FIG. 21 is a side elevational view of another toner container used in the development unit of FIG. 2 wherein the seal member is secured to the toner container near the opening defined therein;

FIG. 22 is a bottom elevational view of the toner container and seal member of FIG. 21.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
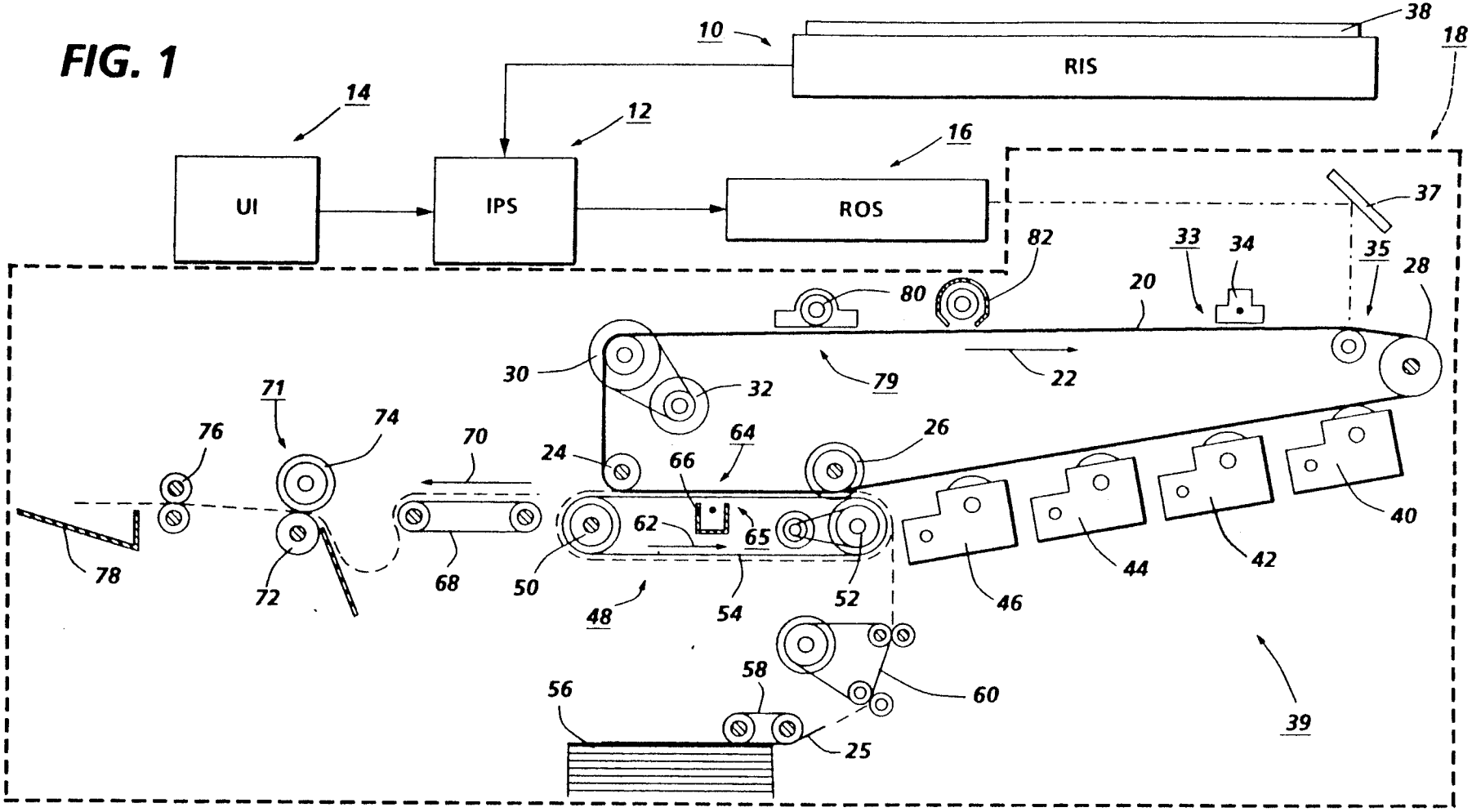
FIG. 1 is a schematic elevational view showing an electrophotographic printing machine incorporating the features of the present invention therein.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. The modulated light beam impinges on the surface of photoconductive belt 20. The beam illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79.

A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
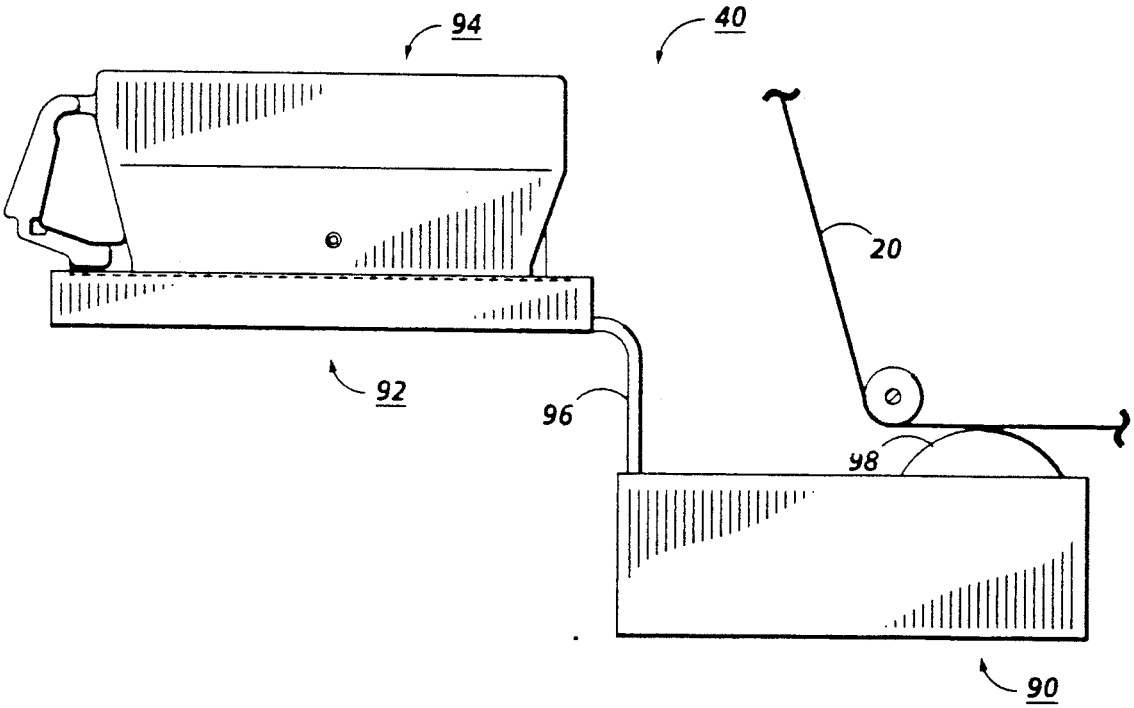
FIG. 2 is a schematic elevational view showing one of the developer units used in the electrophotographic printing machine of FIG. 1.
Figure 16:
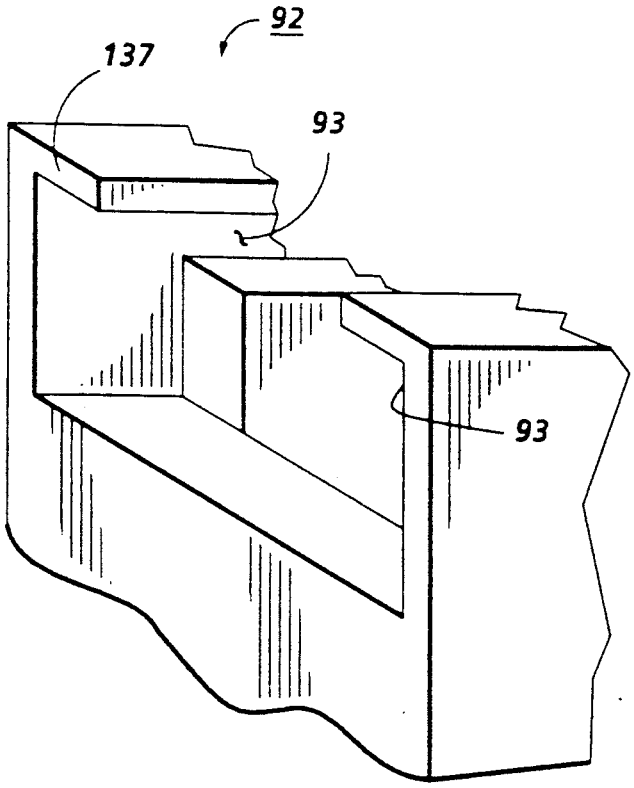
FIG. 16 is a fragmentary perspective view of the dispensing mechanism of FIG. 2.

Referring now to FIG. 2, development unit 40 is shown in greater detail. Development units 40, 42, 44 and 46 of FIG. 1 are substantially identical in structure to one another and thus only development unit 40 will be described in detail. Development unit 40 includes a development system, a toner dispensing mechanism and a toner container, generally designated by the reference numerals 90, 92 and 94, respectively. Dispensing mechanism 92 is operatively coupled to development system 90 by a conduit 96 having a toner auger (not shown) positioned therein. Dispensing mechanism 92 has a pair of grooves 93 defined therein (see FIG. 16) to allow for physical coupling of toner container 94 thereto. Development system 90 contains a developer material which includes a mixture of carrier granules having toner particles adhering triboelectrically thereto. Development system 90 generates a brush 98 of developer material which is brought into contact with the surface of photoconductive member 20 as shown in FIG. 2.

In operation, after recording an electrostatic latent image on photoconductive member 20, the latent image is developed by bringing brush 98 of the developer material into contact therewith. The toner particles are thus attracted to the latent image from the carrier granules to form a toner image on photoconductive member 20. The toner image is subsequently transferred to a copy sheet.

As the toner particles are depleted from the developer material, it is necessary to dispense additional toner particles into the developer material contained in development system 90. In this way, the concentration of toner particles within the developer material is maintained substantially constant. To achieve the above, dispenser mechanism 92 discharges toner particles into development system 90 via conduit 96. However, after a period of use, it is necessary to replenish dispenser mechanism 92 with additional toner particles. As a result, toner container 94 having a supply of toner contained therein is coupled to dispenser mechanism 92.

Figure 5:
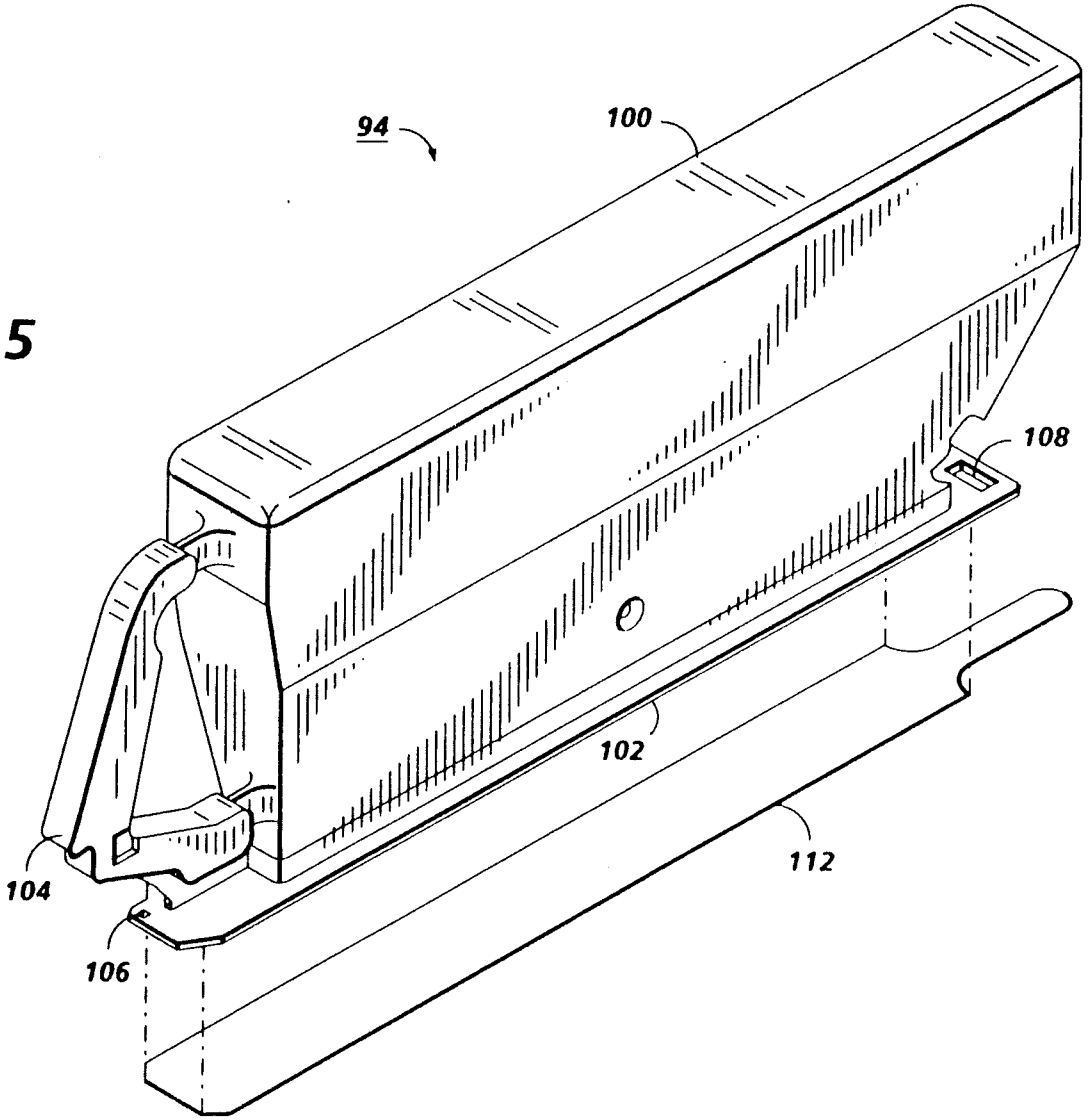
FIG. 5 is an exploded perspective view of the toner container of FIG. 3 with portions thereof removed for clarity of viewing.

Referring now to FIGS. 3–5, toner container 94 includes a hollow body portion 100, a base 102 and a handle 104. Defined within base 102 of toner container 94 is a front aperture 106 and a rear aperture 108. A portion of toner container 94 is shown removed in FIG. 5 to allow viewing of aperture 108. Body portion 100 of toner container 94 is able to store a quantity of toner or marking particles therein. Base 102 of toner container 94 further includes an opening 110 defined therein for the discharge of toner or marking particles from toner container 94 (see FIG. 4). Handle 104 of toner container 94 includes a pair of recesses 129 (see FIGS. 3–4). A sealing strip 112 is shown in FIG. 5 positioned below opening 110. During loading of toner container 94 possessing a quantity of toner particles therein into printing machine 18, sealing strip 112 is secured releasably to base 102 thus covering opening 110 thereby preventing discharge of the toner particles from the toner container. Sealing strip 112 is made from a woven polypropylene material. By way of example, strip 112 can be made from Tyvek, a trademark of E. I. du Pont de Nemours & Co., Inc. of Wilmington, Del.

Figure 6:
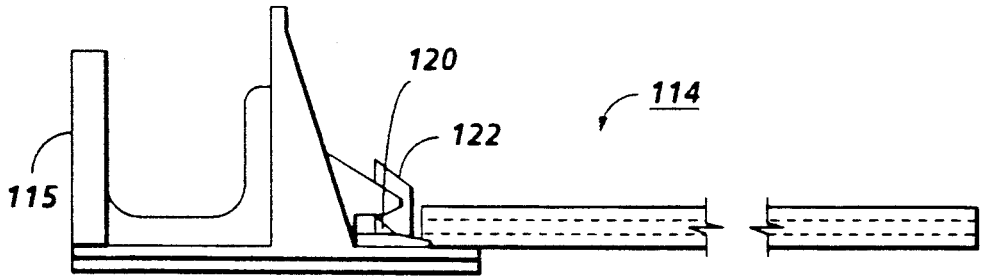
FIG. 6 is a side elevational view of a loading cover used in the development unit of FIG. 2.
Figure 7:
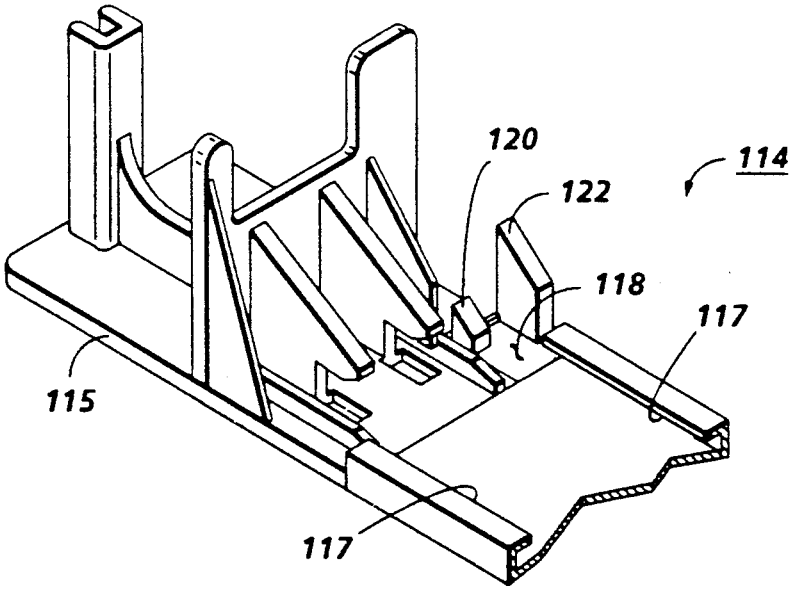
FIG. 7 is a perspective view of the loading cover of FIG. 6.
Figure 8:
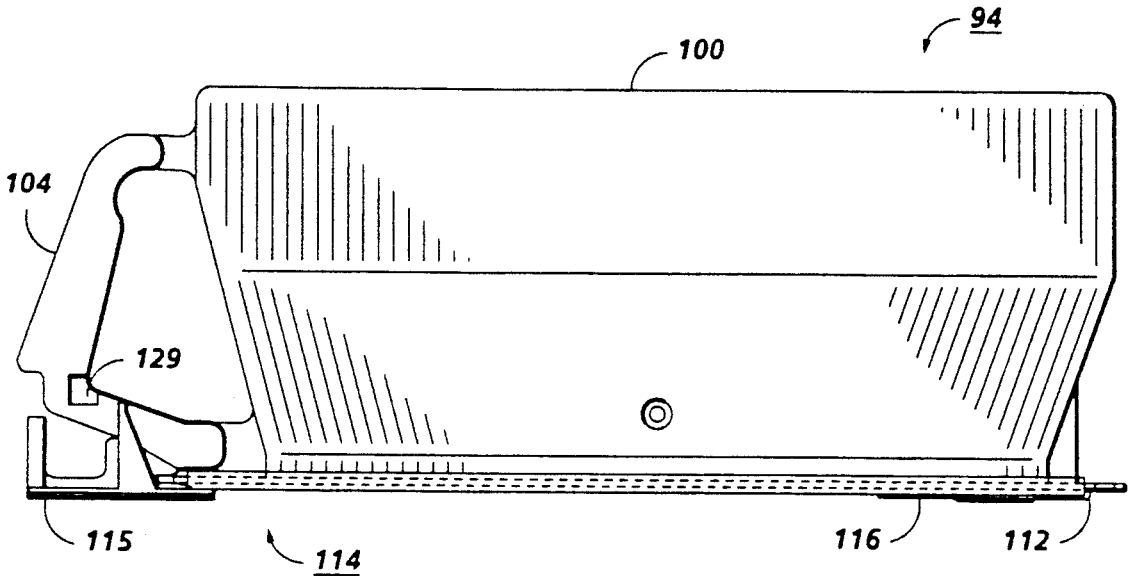
FIG. 8 is a side elevational view of the toner container of FIG. 3 having the loading cover of FIG. 6 engaged and locked thereto.
Figure 9:
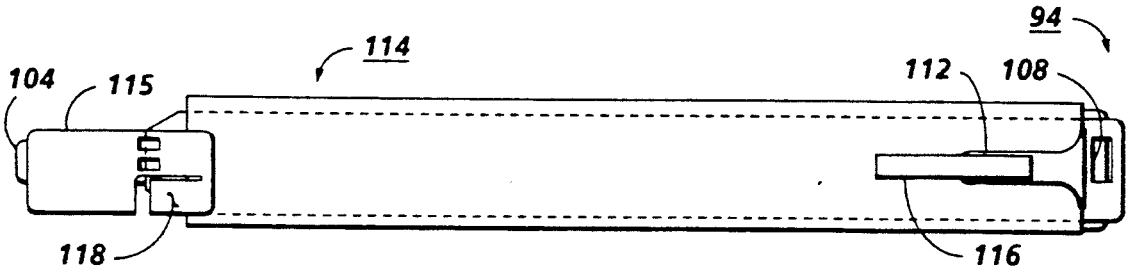
FIG. 9 is a bottom elevational view of the toner container of FIG. 3 having the loading cover of FIG. 6 engaged and locked thereto.

FIGS. 6 and 7 show a toner container opening cover, generally designated by the reference numeral 114, which is positionable on the toner container during shipping and handling thereof and also during loading of the toner container into the printing machine. Defined by loading cover 114 is a pair of grooves 117. Grooves 117 cooperate with base 102 of toner container 94 to cause loading cover 114 to engage toner container 94 in a slidable, friction fit manner. Loading cover 114 includes a handle portion 115. Handle portion 115 of loading cover 114 is made of a plastic material such as impact resistant high density polyethylene. Loading cover 114 may also include a sealing pad (not shown) which spans between the two grooves 117 on the top side of the loading cover. The sealing pad may be made of a resiliently compressible pad constructed, for example, of a low density polyester urethane foam material. FIGS. 8 and 9 show toner container 94 sealed by strip 112 and further having loading cover 114 positioned over strip 112 and engaged to toner container 94. Strip 112 is attached to loading cover 114 by a piece of adhesive tape 116. Loading cover 114 includes a tab 118 having a locking nodule 120 and a release nodule 122 positioned thereon. Locking nodule 120 and release nodule 122 are pivotable due to the manner in which tab 118 is formed within handle portion 115 (see FIG. 9).

Figure 10:
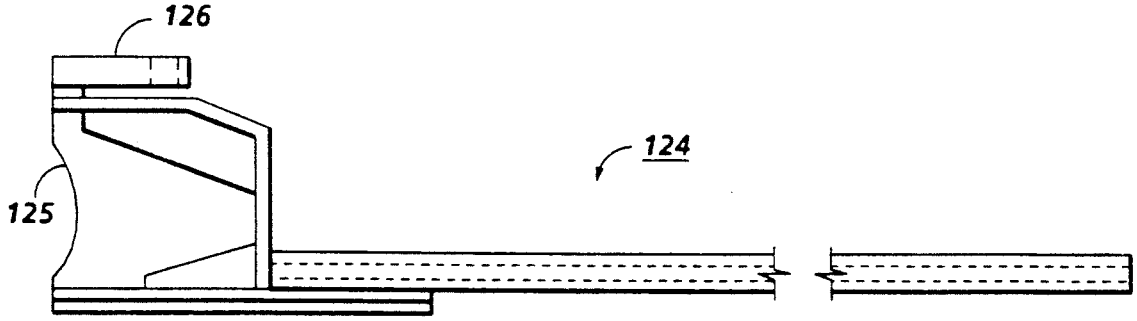
FIG. 10 is a side elevational view of a removal cover used in the development unit of FIG. 2.
Figure 11:
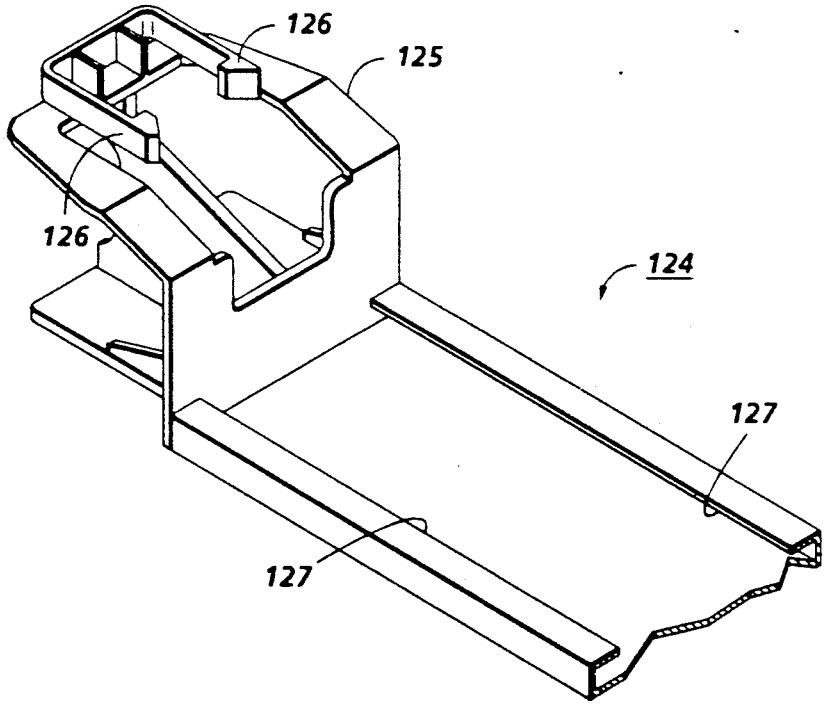
FIG. 11 is a perspective view of the removal cover of FIG. 10.
Figure 12:
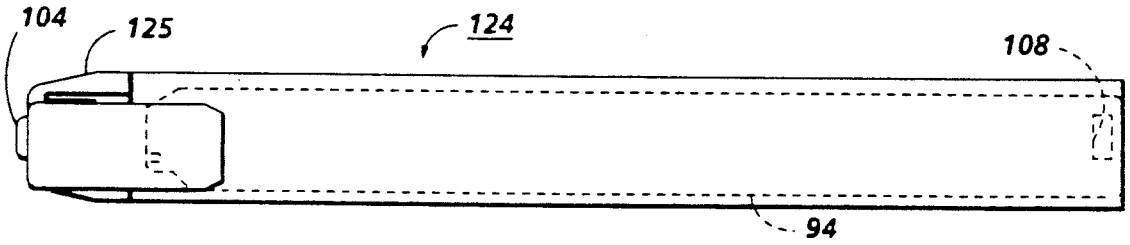
FIG. 12 is a bottom elevational view of the toner container of FIG. 3 having the removal cover of FIG. 10 engaged and locked thereto.

FIGS. 10 and 11 show a toner container opening cover, generally designated by the reference numeral 124, which is positionable on the toner container during removal of the toner container from the printing machine. Removal cover 124 has a pair of grooves 127 defined therein. Grooves 127 cooperate with base 102 of toner container 94 to cause removal cover 124 to engage toner container 94 in a slidable, friction fit manner. Removal cover 124 may also include a sealing pad (not shown) which spans between the two grooves 127 on the top side of the removal cover. The sealing pad may be made of a resiliently compressible pad constructed, for example, of a low density polyester urethane foam material. Removal cover 124 includes a handle portion 125. Handle portion 125 of loading cover 124 is made of a plastic material such as impact resistant high density polyethylene. Handle portion 125 includes a pair of locking arms 126. Each of locking arms 125 are pivotable due to the manner in which the locking arms are formed within handle portion 125 (see FIG. 11). FIG. 12 shows removal cover 124 engaged to toner container 94 and positioned over opening 110 (not shown).

Figure 13:
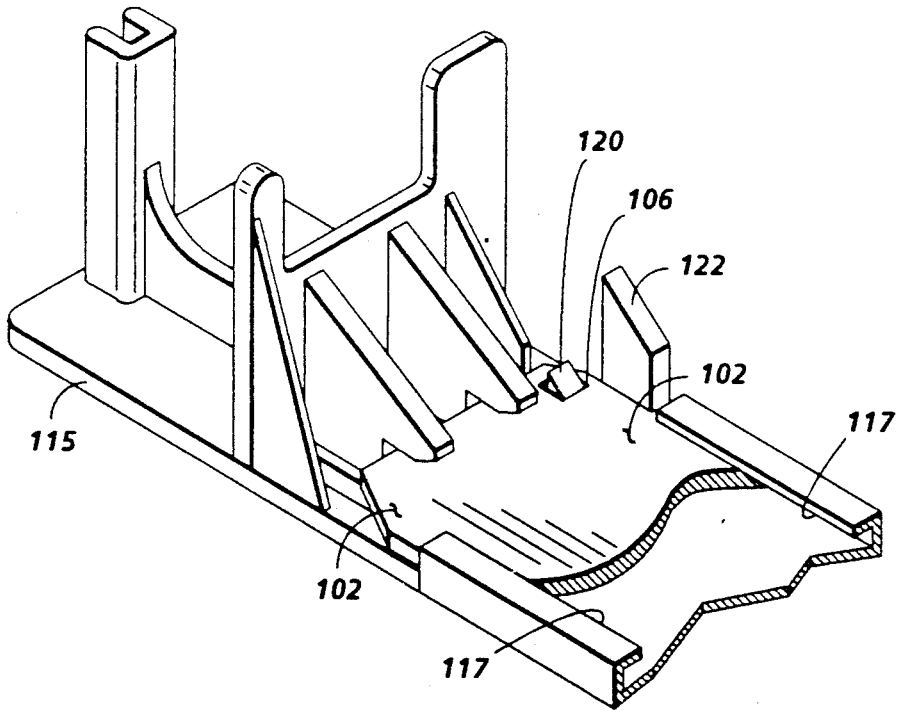
FIG. 13 is a fragmentary perspective view showing the loading cover of FIG. 6 locked onto the toner container of FIG. 3.

During loading of toner container 94 into the printing machine, loading cover 114 is engaged to the toner container (see FIGS. 8, 9 and 13). FIG. 13 shows a front portion of base 102 of toner container 94 positioned within grooves 117 defined by loading cover 114. Also shown in FIG. 13 is the positioning of locking nodule 120 of loading cover 114 within front aperture 106 of base 102 of toner container 94. The positioning of locking nodule 120 within front aperture 106 prevents premature removal of loading cover 114 and consequently sealing strip 112 from toner container 94 thus preventing inadvertent spillage of the toner particles from toner container 94.

Figure 14:
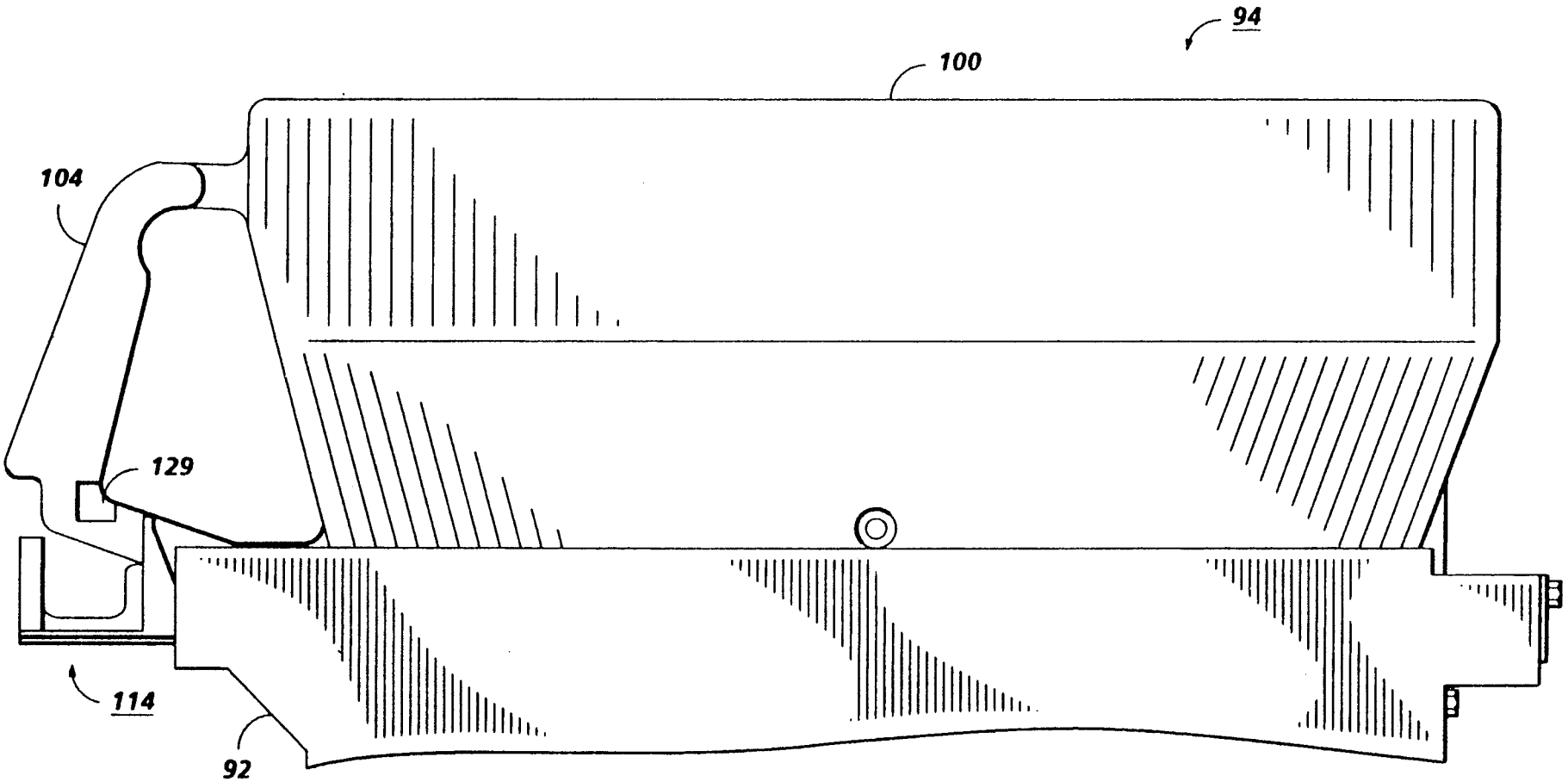
FIG. 14 is a fragmentary side elevational view showing the toner container coupled and locked to the dispensing mechanism and further showing the loading cover engaged but unlocked from the toner container.
Figure 15A:
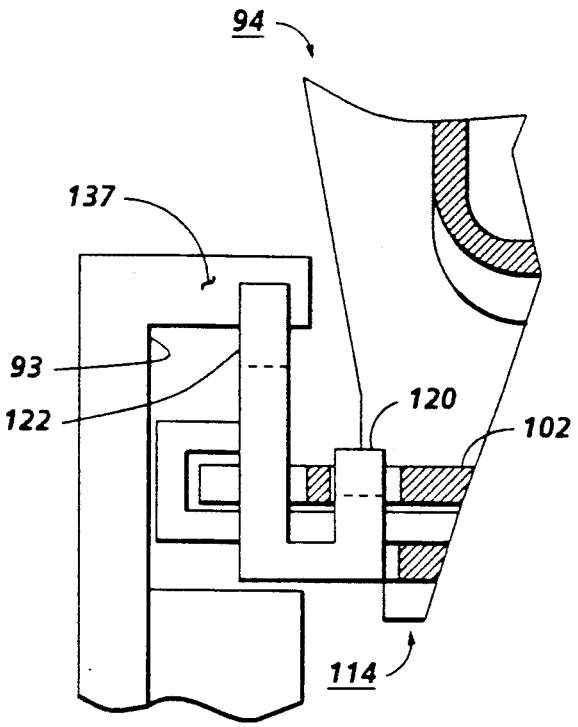
FIG. 15A is a fragmentary sectional elevational view showing the loading cover engaged and locked to the toner container and further showing the toner container coupled to the dispensing mechanism.
Figure 15B:
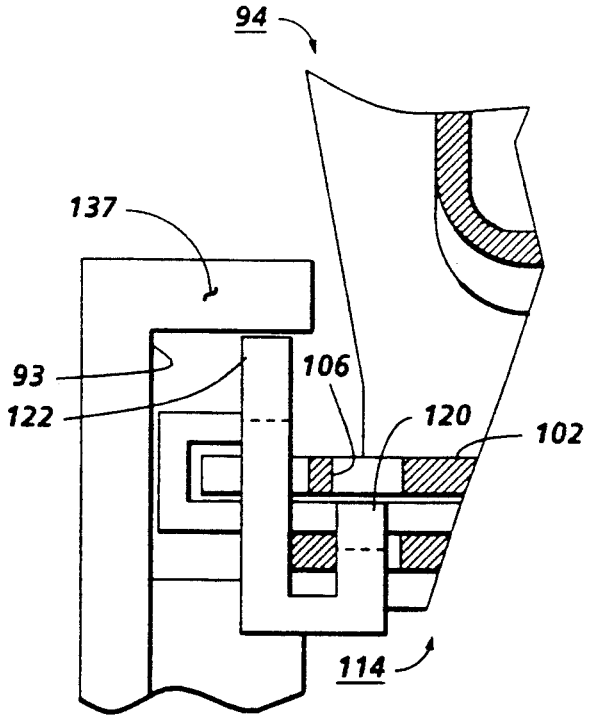
FIG. 15B is a fragmentary sectional elevational view showing the loading cover engaged to but unlocked from the toner container and further showing the toner container coupled to the dispensing mechanism.

As base 102 of toner container 94 having sealing strip 112 and loading cover 114 secured thereto is slid within grooves 93 defined by dispenser mechanism 92, toner container 94 remains locked to loading cover 114 by the positioning of locking nodule 120 within front aperture 106 as shown in FIG. 15A. However, as toner container 94 and consequently loading cover 114 are advanced further within the grooves of the dispenser mechanism, release nodule 122 contacts a cam portion 137 of dispenser mechanism 92. With continued advancement thereof, release nodule 122 is urged downward due to the camming action of cam portion 137 on release nodule 122 as shown in FIG. 15B. As a result, locking nodule 120 is also urged downward thereby unlocking loading cover 114 from toner container 94. FIG. 14 shows toner container 94 coupled to dispensing mechanism 92 while loading cover 114 is unlocked from the toner container.

Figure 17:
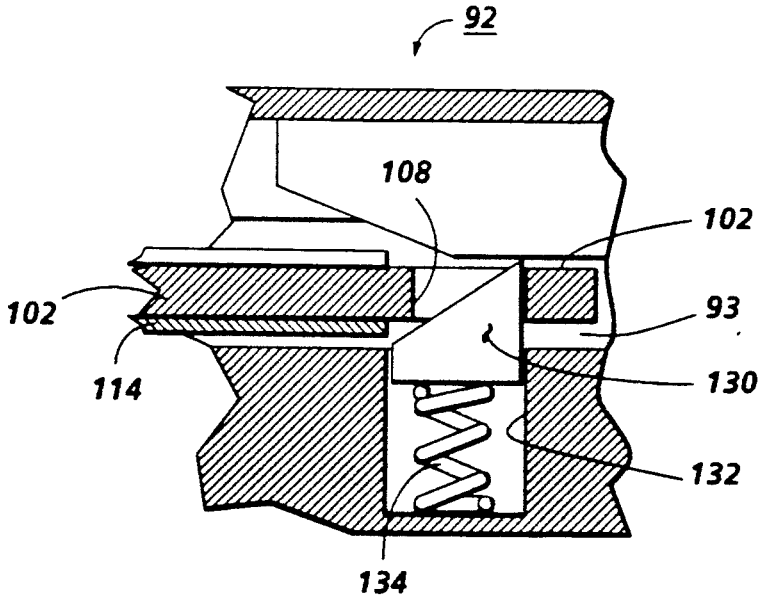
FIG. 17 is a fragmentary sectional elevational view showing the loading cover engaged to the toner container and further showing the toner container locked to the dispensing mechanism.

Referring now to FIG. 17, dispensing mechanism 92 further includes a locking member 130 positioned within a recess 132 defined in the dispensing mechanism. As shown in FIG. 17, lock member 130 is biased toward an uppermost position by a compression spring 134. After base 102 has forced down locking member 130 against the bias of spring 134 as a result of advancement of the toner container in coupling relationship with the dispensing mechanism, rear aperture 108 of base 102 becomes aligned with lock member 130 and the lock member is urged upward and through rear aperture 108 thereby locking toner container 94 to dispensing mechanism 92. The above occurs at about the same time in the point of advancement where the loading cover becomes unlocked from the toner container. FIG. 14 shows toner container 94 coupled and locked to dispensing mechanism 92 while loading cover 114 is unlocked from the toner container. Thereafter, loading cover 114 is pulled in the opposite direction within grooves 93 and out of the dispensing mechanism thereby removing the loading cover and consequently the sealing strip away from opening 110 of toner container 94 so as to release toner particles therefrom and into the dispensing mechanism.

Figure 18:
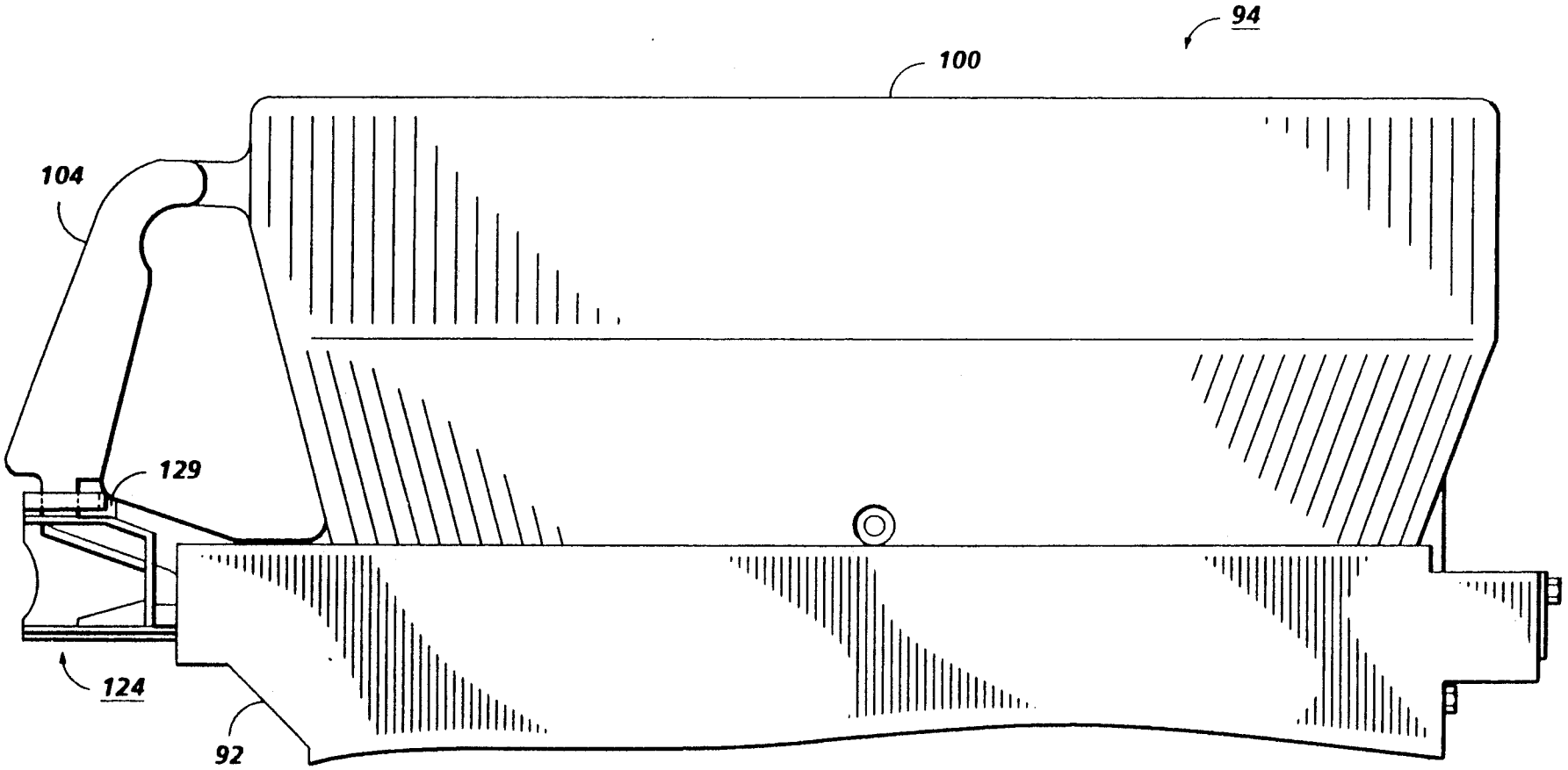
FIG. 18 is a fragmentary side elevational view showing the toner container coupled to but unlocked from the dispensing mechanism and further showing the removal cover engaged and locked to the toner container.

When it is desired to remove toner container 94 from the printing machine, release cover 124 is inserted within grooves 93 of dispensing mechanism 92 and advanced to slidably engage base 102 of toner container 92 in a friction fit manner. Further advancement of release cover 124 into dispensing mechanism 92 causes locking member 130 to be urged downward against the bias of spring 134 and out of rear aperture 108 of base 102 thereby causing toner container 94 to be unlocked from dispensing mechanism 92 as shown in FIG. 19. FIG. 18 shows toner container 94 coupled to dispensing mechanism 92 while the toner container is unlocked from the dispensing mechanism.

At about the same point in advancement of release cover 124 within dispensing mechanism 92, the pair of locking arms 126 of handle portion 125 of release cover 124 are urged away from each other due to the movement of handle 104 of toner container 94 relative to the release cover, and shortly thereafter, the locking arms lock onto the handle of the toner container as shown in FIG. 20. More specifically, the end portion of each locking arm 126 assumes a position within a respective recess 129 defined in handle 104 of toner container 94. The toner container with the release cover locked thereto is then pulled in the opposite direction within the grooves 93 and out of the dispensing mechanism thereby removing the toner container and the attached release cover from the printing machine.

Figure 23:
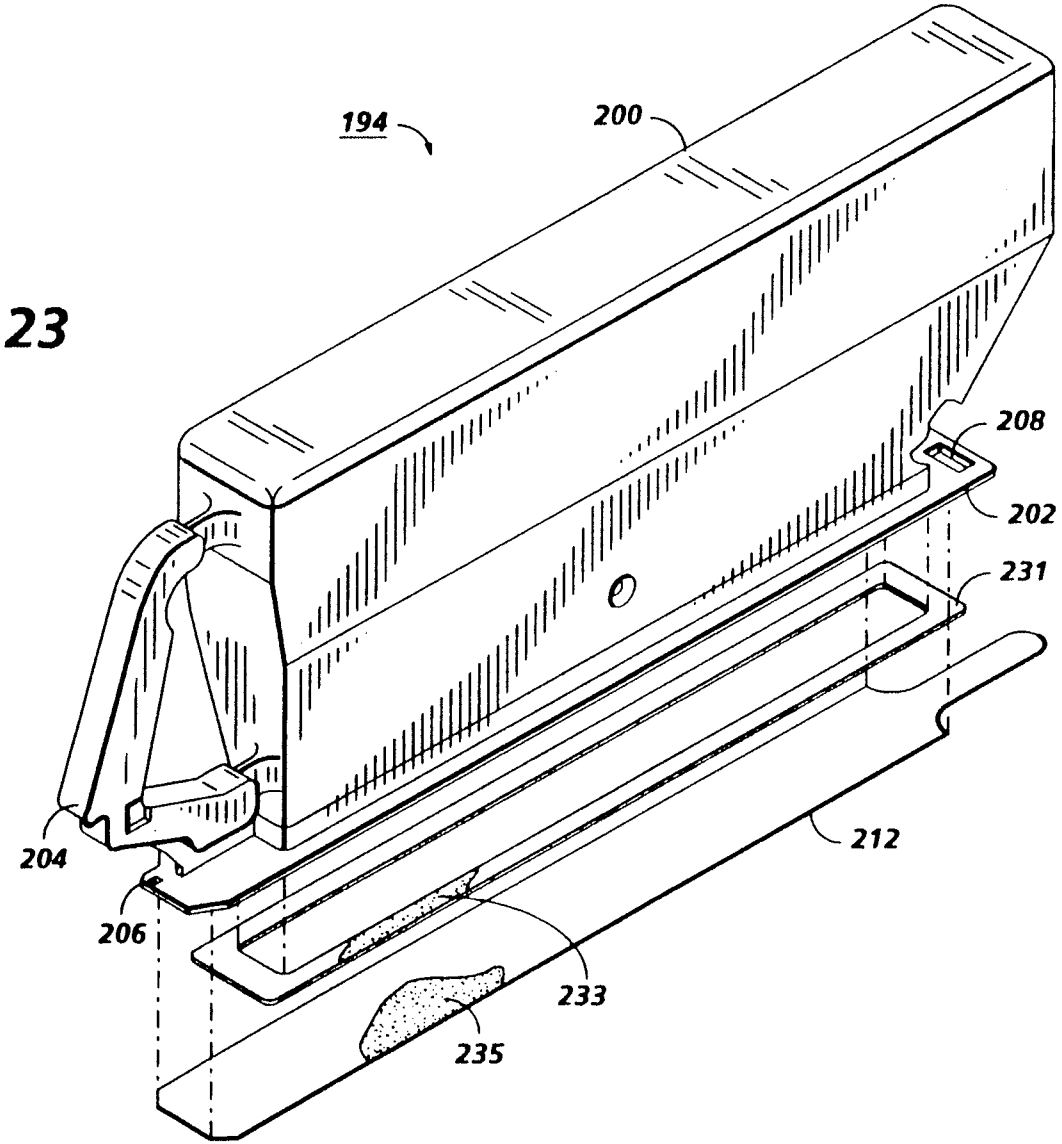
FIG. 23 is an exploded perspective view of the sealing strip and the seal member and toner container of FIG. 21 with portions thereof removed for clarity of viewing.

Another toner container, generally indicated by the reference numeral 194, which may be used with dispensing mechanism 92, is shown in FIGS. 21-23. Toner container 194 includes a hollow body portion 200, a base 202 and a handle 204. Defined within base 202 of toner container 194 is a front aperture 206 and a rear aperture 208. A portion of toner container 194 is shown removed in FIG. 23 to allow viewing of aperture 208. Body portion 200 of toner container 194 is able to store a quantity of toner or marking particles therein. Base 202 of toner container 194 further includes an opening 210 defined therein for the discharge of toner or marking particles from toner container 194 (see FIG. 22). Handle 204 of toner container 194 includes a pair of recesses 229 (see FIGS. 21-22). Positioned around the perimeter of opening 210 of toner container 194 is a seal member 231 which is preferably made from a microcellular polyurethane foam material. By way of example, the microcellular polyurethane foam material may be Poron 4701-01-20 available from Rogers Corporation of East Woodstock, Conn. Seal member 231 is secured to base 202 with an adhesive 233 (partially shown in FIG. 23). Adhesive 233 may be a pressure sensitive adhesive. By way of example, the pressure sensitive adhesive may be a polyester film, modified acrylic adhesive. The polyester film, modified acrylic adhesive may be Scotch #444 available from 3M Corporation of St. Paul, Minn. During loading of toner container 194 possessing a quantity of toner particles therein into printing machine 18, a sealing strip 212 is secured releasably to seal member 231 thus covering opening 210 and thereby preventing discharge of the toner particles from toner container 194. Strip 212 is secured releasably to seal member 231 with another adhesive 235 (partially shown in FIG. 23). Adhesive 235 is coated on the side of strip 212 which faces seal member 231. By way of example, adhesive 235 may be an emulsion heat seal coating adhesive such as RP-300 available from Rollprint Packaging Products, Incorporated of Addison, Ill. Strip 212 is made from a woven polypropylene material. By way of example, strip 212 can be made from Tyvek, a trademark of E.I. duPont de Nemours & Co., Inc. of Wilmington, Del. For clarity of viewing, the toner container 194, the seal member 231 and the strip 212 are shown in an exploded view in FIG. 23.

Toner container 194, having seal member 231 secured thereto and further having sealing strip 212 removably secured to seal member 231, is loaded into the printing machine in a manner similar to that of toner container 94 having sealing strip 112 removably secured thereto as previously described. Moreover, toner container 194 having seal member 231 secured thereto is removed from the printing machine in a manner similar to that of toner container 94 as previously described. Therefore, details of the loading and removal process of toner container 194 into and out of the printing machine, respectively, will not be described in detail.

It should be noted that the bonding strength of adhesive 233 should be greater than the bonding strength of adhesive 235 in order to prevent the accidental removal of seal member 231 from base 202 during the process of removing strip 212 from seal member 231.

In recapitulation, the apparatus for storing marking particles includes a container defining a chamber for storing the marking particles therein and having an opening defined therein for the discharge of the marking particles therefrom. The apparatus further includes a seal member secured to the container, the seal member having an opening defined therein which is at least partially coextensive with the opening of the container for the passage of marking particles therethrough. Moreover, the apparatus includes a cover positionable over the opening defined in the seal member, the cover being removably secured to the seal member with an adhesive material.

It is, therefore, apparent that there has been provided in accordance with the present invention, an apparatus for storing marking particles therein that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for storing marking particles therein, comprising:

a container defining a chamber for storing the marking particles therein and having an opening defined therein for the discharge of the marking particles therefrom;

a seal member secured to said container, said seal member having an opening defined therein which is at least partially coextensive with the opening of said container for the passage of marking particles therethrough; and a cover positionable over the opening defined in said seal member, said cover being removably secured to said seal member with an adhesive material.

2. The apparatus of claim 1, wherein said adhesive material is coated on one side of said cover.

3. The apparatus of claim 1, wherein said seal member is secured to said container with a second adhesive material.

4. The apparatus of claim 3, wherein said second adhesive material comprises a pressure sensitive adhesive material.

5. The apparatus of claim 1, wherein said seal member comprises a microcellular urethane foam material.

6. The apparatus of claim 5, wherein said cover comprises a woven polypropylene material.

7. The apparatus of claim 1, wherein said seal member is positioned around the perimeter of the opening defined in said container.

* * * * *